United States Patent [19]

Pyle

[11] 4,214,614

[45] Jul. 29, 1980

[54] VALVE MEANS FOR PREVENTING FUEL SPILLAGE FROM THE DISCHARGE SPOUT OF A FUEL DISPENSING NOZZLE

[75] Inventor: Walter R. Pyle, Richmond, Calif.

[73] Assignee: Chevron Research Company, San Francisco, Calif.

[21] Appl. No.: 965,980

[22] Filed: Dec. 4, 1978

[51] Int. Cl.[2] ..... B65B 3/26

[52] U.S. Cl. ..... 141/1; 137/614; 141/86; 141/210; 141/301; 222/545

[58] Field of Search ..... 137/614, 614.11; 141/1, 141/46, 59, 86, 198, 207, 208, 287, 290, 210, 301, 302, 392; 222/545, 571; 251/12, 25, 61

[56] References Cited

U.S. PATENT DOCUMENTS

| | | | |
|---|---|---|---|
| 4,058,149 | 11/1977 | Hansel | 141/301 |
| 4,060,108 | 11/1977 | Weston et al. | 141/59 |
| 4,060,110 | 11/1977 | Bower | 141/207 |

FOREIGN PATENT DOCUMENTS

| | | | |
|---|---|---|---|
| 931756 | 8/1955 | Fed. Rep. of Germany | 141/392 |

*Primary Examiner*—Frederick R. Schmidt

*Attorney, Agent, or Firm*—R. L. Freeland, Jr.; William J. Egan, III

[57] ABSTRACT

A valve means for a fuel dispensing nozzle located in the nozzle discharge spout at the outlet end thereof for sealing the outlet end to prevent the flow of fuel and fuel vapors out of the discharge spout when the nozzle flow control valve is closed. The valve means is responsive to the operation of the flow control valve so that when the flow control valve is closed, the valve means is closed and so that when the flow control valve is operated to flow fuel through the discharge spout, the valve means is open. To this purpose, actuating means responsive to the operation of the flow control valve are provided to establish fluid communication between the valve means and the flow passage upstream of the flow control valve and, alternately, between the valve means and the flow passage in the discharge spout. In one embodiment, the valve means located in the discharge spout at the outlet end thereof is a pinch valve, and in another embodiment, the valve means is a wafer valve. In each embodiment, the valves are operable by the fuel pressure available in the nozzle.

6 Claims, 6 Drawing Figures

VALVE MEANS FOR PREVENTING FUEL SPILLAGE FROM THE DISCHARGE SPOUT OF A FUEL DISPENSING NOZZLE

FIELD OF THE INVENTION

The present invention relates to liquid fuel dispensing nozzles for dispensing fuel into vehicle fuel tanks, and more particularly, to a valve means for sealing the outlet end of a discharge spout of a fuel dispensing nozzle in order to prevent the flow of fuel and fuel vapors therethrough, the present invention being especially applicable to those nozzles having vapor-recovery systems.

BACKGROUND OF THE INVENTION

In an attempt to reduce hydrocarbon emissions, environmental regulations in certain areas of the country require that gasoline vapors displaced from vehicle fuel tanks during refueling are to be recovered to prevent their escape into the atmosphere. Accordingly, nozzle assemblies incorporating vapor recovery systems have been designed to comply with these regulations. As is known in the art, many of these nozzles have a vapor-recovery system for receiving the vapors displaced from the fuel tank and storing them in a service station's underground hydrocarbon storage tank. These nozzles normally include a discharge spout that extends into the mouth of the fill pipe of the fuel tank and a vapor-recovery shroud that fits in sealing engagement with the mouth of the fill pipe during refueling so as to receive the vapors displaced from the fuel tank. With this arrangement, vapors in the fuel tank are displaced from the tank as fuel is pumped into the tank. The displaced vapors will then flow by way of the shroud into a vapor-recovery passage in the nozzle and from there by appropriate means to a hydrocarbon storage tank.

A problem that commonly arises in the use of vapor-recovery nozzles, as well as when using fuel dispensing nozzles not incorporating a vapor-recovery system, is the occurrence of fuel spills from the discharge spout of the nozzle. When the nozzle is shut off at the termination of vehicle refueling, some fuel usually remains in the discharge spout of the nozzle, and upon removal of the nozzle from the fill pipe, the fuel remaining in the discharge spout may spill from the spout, striking the vehicle, the operator of the nozzle or the ground. Any fuel that does not spill from the spout may evaporate in the spout when the nozzle is not in use and stored in the fuel dispenser. When fuel spillage occurs either by fuel spilling from the discharge spout or by fuel vapors escaping therefrom, hydrocarbon emissions will be produced, offsetting the gain made towards the recovery of escaping fuel vapors by the use of vapor-recovery nozzles.

Fuel dispensing nozzles that are currently available, such as those described in U.S. Pat. Nos. 4,060,110 (Bower) and 4,058,149 (Hansel), are not designed to eliminate the heretofore-described problem. Accordingly, the present invention is directed to a valve means for sealing the outlet end of a discharge spout of a fuel dispensing nozzle so that fuel and fuel vapors remaining in the discharge spout subsequent to refueling are prevented from escaping therefrom.

SUMMARY OF THE INVENTION

In accordance with the present invention, a valve means for a fuel dispensing nozzle is provided wherein the valve is located in the discharge spout at the outlet end thereof for sealing the outlet end to prevent the flow of fuel and fuel vapors therethrough when the nozzle flow control valve is closed. When the nozzle flow control valve is operated to flow fuel through the discharge spout, the valve means is open to permit the flow of fuel out of the discharge spout. Actuating means are provided for connecting the valve means with the nozzle flow control valve so that the valve means is responsive to the operation of the nozzle flow control valve.

The valve means of the present invention is preferably either a pinch valve or a wafer valve, both of which are operable by the fuel pressure available in the nozzle. The actuating means of the present invention includes a bleed valve which is operatively connected to the flow control valve to provide the necessary means for opening and closing the valve means in response to the operation of the flow control valve. A first fluid passageway connects the flow passage upstream of the flow control to the valve means to provide a fluid pressure of approximately 30 psi to the valve means to close the valve means when the flow control valve is closed. A second fluid passageway is connected between the first fluid passageway and an inlet port of the bleed valve. A check valve is located in the first fluid passageway upstream of the point of connection between the first and second fluid passageways to prevent the flow of fuel from the valve means to the flow passage upstream of the flow control valve. A third fluid passageway connects the flow passage in the discharge spout to an outlet port of the bleed valve to provide a fluid passage for the flow of fuel from the valve means to the discharge spout. When the bleed valve is open in response to the opening of the flow control valve, a pressure differential is established between the valve means, which is being supplied fuel at a pressure of 30 psi, and the flow passage in the discharge spout, which is at atmospheric pressure, such that fuel flows from the valve means to the discharge spout thereby opening the valve means. When the flow control valve is closed, the bleed valve is closed; thus, fuel flows through the first fluid passageway to provide the fluid pressure necessary to close the valve means.

PRINCIPAL OBJECT OF THE INVENTION

A particular object of the present invention is to provide a valve means responsive to the operation of the nozzle flow control valve wherein the valve means is located in the nozzle discharge spout at the outlet end thereof for sealing the outlet end of the discharge spout to prevent the flow of fuel and fuel vapors therethrough when the nozzle flow control valve is closed, the valve means being opened to open the outlet end of the discharge spout when the flow control valve is operated to flow fuel through the discharge spout.

Additional objects and advantages of the invention will become apparent from a detailed reading of the specification and drawings which are incorporated herein and made a part of this specification.

DESCRIPTION OF THE PREFERRED EMBODIMENT

For illustrative purposes, the present invention is described with respect to a vapor-recovery dispensing nozzle of the type shown in U.S. Pat. No. 4,060,110. It is noted, however, that this invention may be used with most any type of liquid fuel-dispensing nozzle, including nozzles not having a vapor-recovery system.

Figure 1:
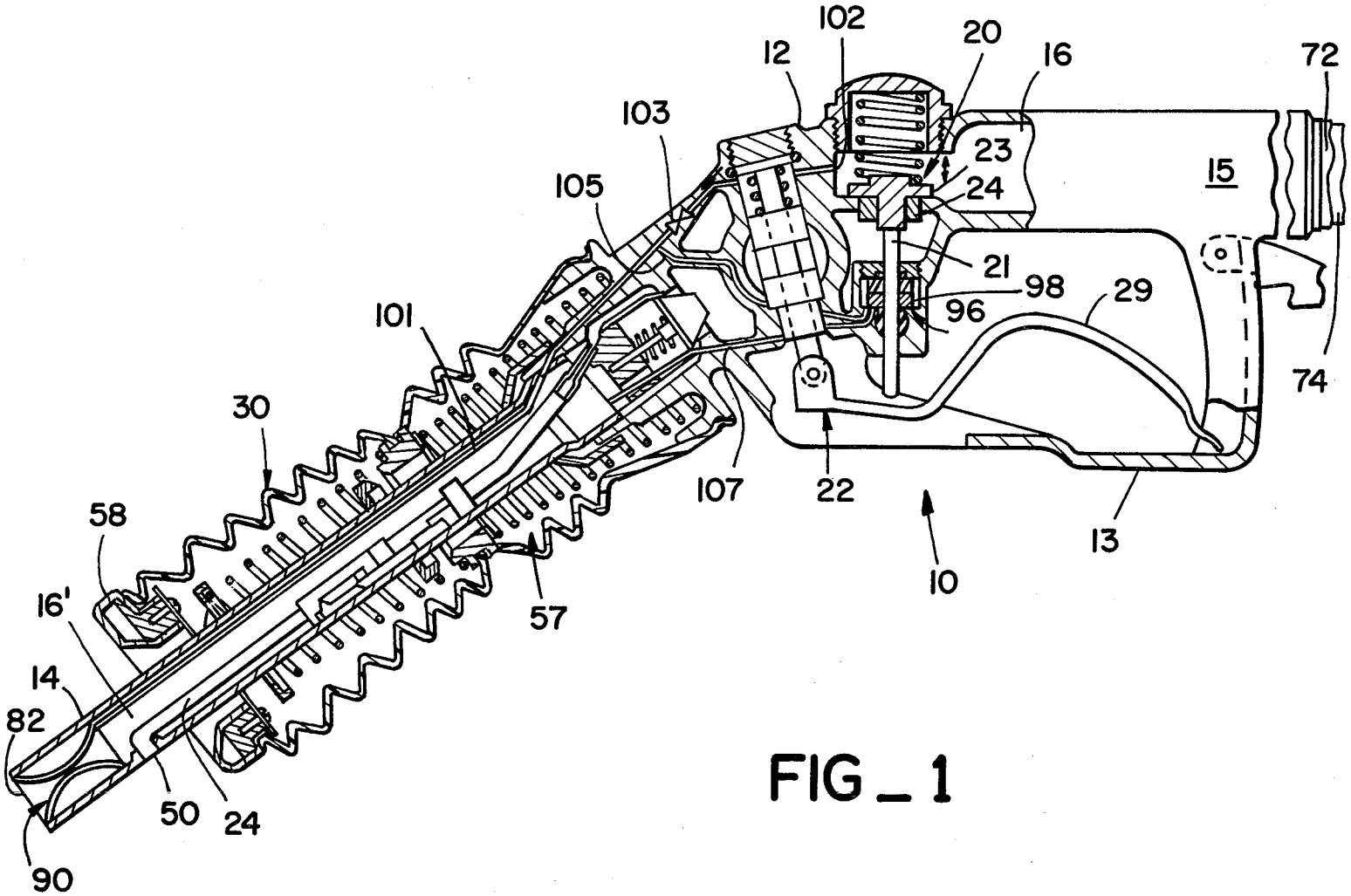
FIG. 1 is a longitudinal sectional view of a vapor-recovery dispensing nozzle according to an embodiment of the present invention.

Referring now to the drawings, FIG. 1 represents a vapor-recovery dispensing nozzle 10 having a main body portion 12 with an open-end discharge spout 14 projecting from the nozzle main body portion for insertion into a fill pipe, not illustrated, of a vehicle fuel tank. The discharge spout has an outlet end 82 proportioned for ease of insertion into the fill pipe of the fuel tank. A liquid flow passage, indicated by reference numerals 16 and 16', extends through the main body portion 12 and the discharge spout 14. That part of the liquid flow passage extending through the main body portion 12 and which is referred to as numeral 16 is in communication at one end thereof with that part of the liquid flow passage, referred to as numeral 16', in the discharge spout 14. The other end of flow passage 16 is in communication with a fuel hose 72 which is connected between the nozzle 10 and a fuel dispenser, which is not illustrated.

A flow control valve, indicated generally by the reference numeral 20, is located in the flow passage 16 for opening and closing the passage to regulate the flow of fuel through the passage. Flow control valve 20 may be operated to flow fuel through flow passage 16 and thus through flow passage 16' in the discharge spout by squeezing lever 29 of the releasable latching mechanism, identified generally by numeral 22, in the direction toward handle 15. When lever 29 is squeezed towards handle 15, flow control valve plunger 21 is moved in an upward direction lifting flow control valve head 23 from flow control valve seat 24; this permits fuel to flow through flow passage 16 downstream of flow control valve 20 and into flow passage 16' in the discharge spout. A guard 13 may be provided to protect lever 29 as well as to provide a support for holding the nozzle when it is stored in the fuel dispenser when not in use.

The nozzle may also have a vacuum-operated release mechanism for automatically closing flow control valve 20 when the level of fuel in the tank being filled reaches the end of the discharge spout. To this purpose, and as is well known in the art, a vent tube 24 extends through the discharge spout 14 and has an opening or port 50 through the lower surface of the discharge spout near the outlet end 82 thereof. Releasable latching mechanism 22 is automatically operated to close the valve 20 when normal venting of the vacuum mechanism by way of vent tube 24 is interrupted, which occurs when the level of fuel in the tank being filled rises to a level sufficient to close vent passage opening 50.

The vapor-recovery system for the nozzle 10 essentially includes a vapor-recovery shroud, indicated generally by numeral 30, which is positioned around the discharge spout 14 and which extends from a soft annular sealing collar 58 to the nozzle main body portion 12. The collar 58 is provided for sealingly engaging the fuel tank fill pipe so that vapors displaced from the fuel tank during refueling will be carried back to a vapor-recovery passage, indicated generally by reference numeral 57, which extends through shroud 30 and nozzle main body portion 12 where it is connected to a vapor-recovery line 74. Since the structure of the vapor-recovery system is well known, it has not been described in any detail. A detailed description of the operation of this vapor-recovery system may be found in U.S. Pat. No. 4,060,110. An .alternate vapor-recovery system is described in U.S. Pat. No. 4,058,149.

Figure 2A:
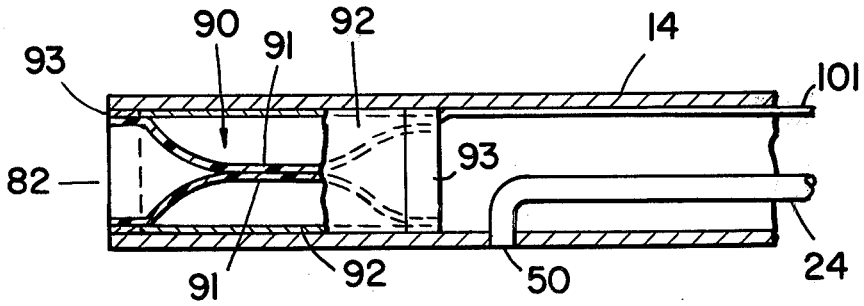
FIG. 2A is an enlarged fragmentary view illustrating the pinch valve of FIG. 1 in a closed position.
Figure 2B:
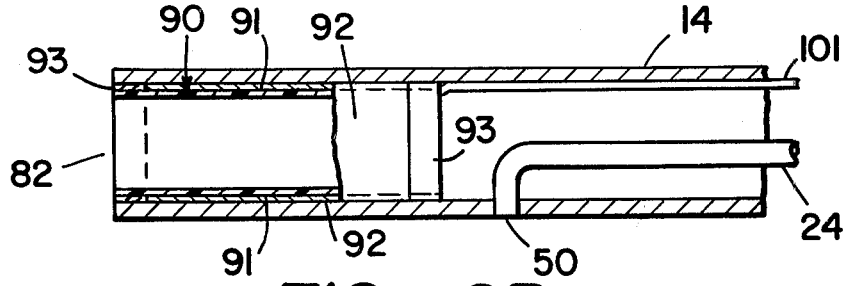
FIG. 2B is a view illustrating the pinch valve of FIG. 2A in an open position.

As discussed heretofore, when the nozzle is shut off after refueling, some fuel will usually remain in the flow passage 16' in the discharge spout. This fuel may either spill from the discharge spout when the nozzle is being handled or evaporate in the discharge spout when the nozzle is stored in the fuel dispenser. In either case, such fuel spillage will produce hydrocarbon emissions, offsetting the gain made towards the control of vapor emissions by use of vapor-recovery nozzles. In accordance with an embodiment of the present invention, a pinch valve, generally indicated by reference numeral 90, as illustrated in FIGS. 1, 2A and 2B, is provided for sealing the outlet end 82 of the discharge spout 14 to prevent the flow of fuel and fuel vapor out of the discharge spout and into the atmosphere when the nozzle is shut off. The pinch valve 90 is located in the discharge spout 14 at the outlet end 82 thereof where it is secured by any appropriate means, such as retainer rings 93. The outer end of pinch valve 90 is located inwardly of the outlet end 82 so that it will not be subjected to damage when the nozzle is being used. The inner end of pinch valve 90 is located outwardly of port 50 so that it will not interfere with the operation of the vacuum-operated release mechanism.

As is known in the art, the pinch valve may generally consist of a resilient sleeve 91, as shown in FIGS. 2A and 2B, arranged within a valve housing 92, which as mentioned above may be secured in the discharge spout by means of retainer rings 93, such that there is an annular space formed between the valve housing 92 and the resilient sleeve 91. A pinch valve is designed to open and close by the action of air or hydraulic pressure acting on the resilient sleeve wherein the pressure is applied to the annular space between the sleeve and the housing. In the present invention, pinch valve 90 is preferably operated by the fuel pressure available in the nozzle. When pinch valve 90 is closed, as shown in FIG. 2A, the surfaces of sleeve 91 on opposite sides of the valve sealingly engage one another to provide a fuel and vapor-tight seal which prevents the escape of fuel and fuel vapors from the discharge spout when the nozzle is shut off. Accordingly, the resilient sleeve should be fabricated from a material, such as buna-n, that is resistant to deterioration, shrinkage and swell when exposed to fuel and fuel vapors. The valve housing 92 may also be made from buna-n or from some other material, such as aluminum, that is resistant to the deleterious effects of fuel.

As discussed hereinabove, flow passage 16 is connected by means of fuel hose 72 to the fuel dispenser which supplies fuel to the nozzle at a fluid pressure of approximately 30 psi; therefore, a fuel pressure of approximately 30 psi is available to actuate pinch valve 90. To this purpose, a fluid passageway 101 is provided to establish fluid communication between pinch valve 90 and flow passage 16 upstream of flow control valve 20. Fluid passageway 101 extends from a port 102 in flow passage 16 upstream of the flow control valve through the nozzle main body portion and the discharge spout to pinch valve 90. In this manner, pinch valve 90 is in fluid communication with flow passage 16 upstream of flow control valve 20 so that fuel flows from flow passage 16 to pinch valve 90 at a fluid pressure of approximately 30 psi. That portion of fluid passageway 101 extending through the nozzle main body portion 12, as well as those fluid passageways discussed below which extend through the nozzle main body portion, can either be cast or machined in the main body portion during fabrication of the nozzle. Likewise, that part of fluid passageway 101 extending through the discharge spout may be cast as part of the discharge spout, or this part of fluid passageway 101 may be a fluid conduit that extends through flow passage 16' or along the outer surface of the discharge spout.

Figure 3:
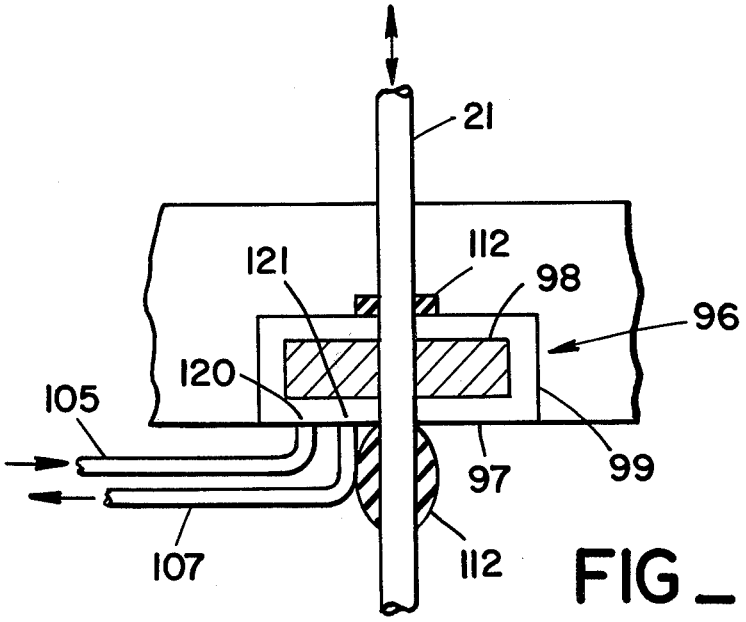
FIG. 3 is an enlarged view illustrating in greater detail the bleed valve means shown in FIG. 1.

A second fluid passageway 105 is connected between fluid passageway 101 and a bleed valve, indicated generally by numeral 96. A check valve 103 is located in fluid passageway 101 upstream of the point of connection between fluid passageways 101 and 105 to prevent the flow of fuel from pinch valve 90 to flow passage 16 upstream of flow control valve 20. Bleed valve 96, one type of which is illustrated in FIG. 3, has an inlet port 120 connected to fluid passageway 105 and an outlet port 121 connected to a third fluid passageway 107, which is connected at its opposite end to flow passage 16' in discharge spout 14. Bleed valve 96 is designed to be actuated by flow control valve 20, as will be explained in more detail below, to open pinch valve 90 when flow control valve 20 is operated to flow fuel through the liquid flow passage and to close pinch valve 90 to seal outlet end 82 when flow control valve 20 is closed.

In the present invention, bleed valve head 98 is located in bleed valve housing 99 and operatively affixed to flow control valve plunger 21 to move up and down in response to the movement of plunger 21. As discussed above, plunger 21 is connected to flow control valve head 23 which moves up and down with respect to flow control valve seat 24 in operation of the flow control valve. When flow control valve 20 is closed, bleed valve 96 is closed in that bleed valve head 98 sealingly engages bleed valve seat 97 to prevent the flow of fuel from fluid passageway 105 to fluid passageway 107 through the bleed valve. When flow control valve 20 is operated to flow fuel through the liquid flow passage, bleed valve 96 is open. In the open position, bleed valve head 98 will be raised from bleed valve seat 97 thereby establishing fluid communication between fluid passageways 105 and 107 through the bleed valve by means of inlet port 120 and outlet port 121, respectively. A fluid-tight packing 112 or a bellows seal, not illustrated, may be provided around bleed valve housing 99 so that there is a fluid-tight seal between flow control valve plunger 21 and the housing to prevent fuel from leaking from the housing.

In operation of the present invention, when bleed valve 96 is closed in response to flow control valve 20 being closed, fuel will flow from flow passage 16 upstream of flow control valve 20 through port 102 and fluid passageway 101 to the annular space between the pinch valve sleeve 91 and the pinch valve housing 92, supplying a fluid pressure of approximately 30 psi to the annular space which causes pinch valve 90 to close. When flow control valve 20 is operated to flow fuel through the liquid flow passage, bleed valve 96, in response to the operation of flow control valve 20, will open establishing fluid communication between pinch valve 90 and flow passage 16' in the discharge spout, which causes pinch valve 90 to open. To explain more fully, the pressure in flow passage 16' is at approximately atmospheric pressure and the fuel supplied to pinch valve 90 flows at a pressure of approximately 30 psi; therefore, when bleed valve 96 is open, a pressure differential is established across bleed valve 96 which causes fuel to flow from pinch valve 90 through fluid passageways 101, 105 and 107 into flow passage 16' where it flows through the outlet end of the discharge spout. As discussed above, check valve 103 prevents the flow of fuel from pinch valve 90 to flow passage 16 upstream of flow control valve 20 so that all the fuel flowing out of pinch valve 90 when bleed valve 96 is open flows into flow passage 16'. Further, port 102 may have an opening that is sufficiently small so that when flow control valve 20 is open, very little fuel will flow into fluid passageway 101, and any fuel that does flow through port 102 into fluid passageway 101 when bleed valve 96 is open will flow from there through fluid passageways 105 and 107 to flow passage 16'.

From the above description of the invention, it can be seen that when flow control valve 20 is closed, pinch valve 90 is closed to seal the outlet end of the discharge spout to prevent the flow of fuel and fuel vapors therethrough. On the other hand, when flow control valve 20 is operated to flow fuel through the liquid flow passage and into the tank being refueled, pinch valve 90 is open to provide an unrestricted flow passage for the flow of fuel out of the outlet end of the discharge spout.

Figure 4A:
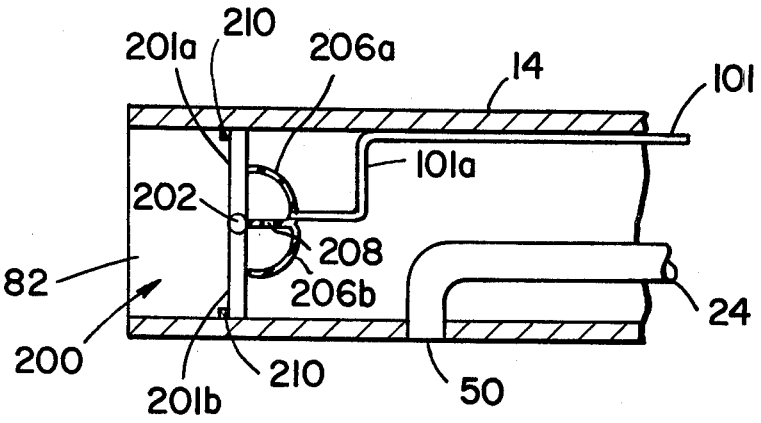
FIG. 4A is an enlarged fragmentary view of the outlet end of a discharge spout of a fuel dispensing nozzle illustrating another embodiment of the present invention wherein a wafer valve, shown in a closed position, is provided for sealing the outlet end of the discharge spout.
Figure 4B:
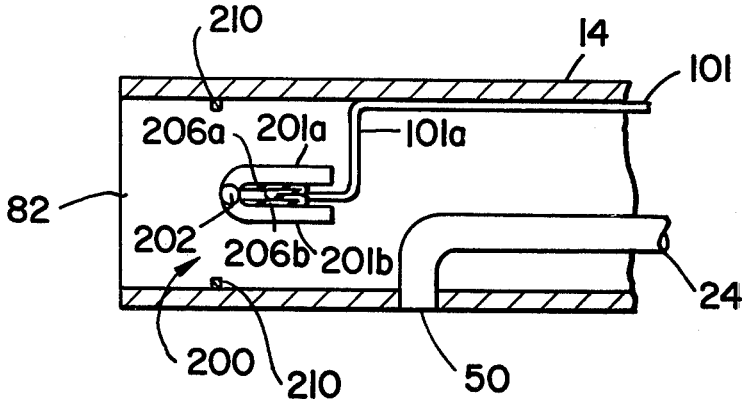
FIG. 4B is a view illustrating the wafer valve of FIG. 4A in an open position.

With reference to FIGS. 4A and 4B, another embodiment of the present invention, a wafer valve, indicated by reference numeral 200, is shown. Wafer valve 200 essentially consists of two substantially semi-circular discs **201*a* and 201*b* pivotally arranged around a shaft 202 which extends from one side of the discharge spout to the other side to support the discs therein. When wafer valve 200 is closed, as illustrated in FIG. 4A, discs 201*a* and 201*b* sealingly engage the inner surface of a valve seat 210, which is circumferentially arranged along the inner surface of the discharge spout, to provide a fuel and vapor-tight seal that seals the outlet end 82 of the discharge spout to prevent the escape of fuel and fuel vapors therethrough. The discs are also sealingly joined to shaft 202 in a manner that provides a fuel and vapor-tight seal between shaft 202 and the discs. As is known in the art, the discs are joined to shaft 202 to pivot thereabout through 90° of movement from a vertical position when closed, see FIG. 4A, to a horizontal position when open, see FIG. 4B**. As with the pinch valve sleeve and housing, the discs should be fabricated from a material, such as buna-n or aluminum, that is resistant to the deleterious effects of fuel and fuel vapors.

Wafer valve 200, like pinch valve 90, is operated to be in closed position when flow control valve 20 is closed and to be in an open position when control valve 20 is open. In this respect, the actuating system for wafer valve 200 is the same as that used with pinch valve 90 except that fluid passageway 101 has an extension 101*a* which extends into flow passage 16' to a point between discs 201*a* and 201*b* to establish fluid communication with a pair of inflatable balloon-like members 206*a* and 206*b*. Members 206*a* and 206*b* are in fluid communication with each other by means of a port 208 and are affixed to the backs of discs 201*a* and 201*b*, respectively. When flow control valve 20 is closed, and thus bleed valve 96 is closed, fuel at a pressure of approximately 30 psi will be supplied to members 206*a* and 206*b* through fluid passageways 101 and 101*a*, filling members 206*a* and 206*b* with fuel causing them to inflate to close wafer valve 200 as discs 201*a* and 201*b* sealingly engage valve seat 210. When flow control valve 20 is operated to flow fuel through the liquid flow passage, as discussed heretofore, bleed valve 96 will open resulting in the flow of fuel out of members 206*a* and 206*b* and through fluid passageways 101*a*, 101, 105 and 107 into flow passage 16'; this will cause members 206*a* and 206*b* to deflate opening wafer valve 200 so that fuel may flow through the outlet end of the discharge spout.

It should also be noted that the wafer valve of the present invention could possibly be actuated by some type of mechanical system, as opposed to the above-described fuel-actuation system, wherein a mechanical linkage interconnects the wafer valve and the nozzle flow control valve so that the wafer valve is responsive to the operation of the flow control valve. It would also be possible to use in place of the wafer valve and pinch valve some other type of valve, such as an iris, butterfly or flapper valve; these alternate valves could then be either actuated by a fuel-actuation or mechanical system.

SUMMARY OF THE ADVANTAGES

The valve means of the present invention offers a relatively simple and economic means for eliminating the flow of fuel and fuel vapor through the outlet end of a nozzle discharge spout when the nozzle is not in operation, thereby preventing hydrocarbon emissions associated with such fuel spillage.

Although certain specific embodiments of the invention have been described in detail, the invention is not to be limited to only such embodiments but rather by the appended claims.

What is claimed:

1. A fuel-dispensing nozzle, comprising: a nozzle main body portion, a discharge spout projecting from the main body portion, said discharge spout having an outlet end proportioned for ease of insertion into a fill pipe of a fuel tank, a flow passage extending through the nozzle main body portion and said discharge spout for the flow of fuel therethrough, a flow control valve in the nozzle main body portion operable to regulate the flow of fuel through said flow passage, valve means operable by a fluid pressure located in said discharge spout adjacent to the outlet end thereof for sealing the outlet end of said discharge spout to prevent the flow of fuel therethrough when said flow control valve is closed and for opening the outlet end of said discharge spout to permit flow of fuel therethrough when said flow control valve is operated to flow fuel through said flow passage, and means for supplying a fluid pressure to said valve means to close said valve means to prevent the flow of fuel out of said discharge spout when said flow control valve is closed and for removing the fluid pressure supplied to said valve means to open said valve means to permit the flow of fuel through the outlet end of said discharge spout when said flow control valve is operated to flow fuel through said flow passage.

2. A fuel-dispensing nozzle, comprising: a nozzle main body portion, a discharge spout projecting from the main body portion, said discharge spout having an outlet end proportioned for ease of insertion into a fill pipe of a fuel tank, a flow passage extending through the nozzle main body portion and said discharge spout for the flow of fuel therethrough, a flow control valve in the nozzle main body portion operable to regulate the flow of fuel through said flow passage, valve means, operable by a fluid pressure and responsive to the operation of said flow control valve, located in said discharge spout adjacent to the outlet end thereof for sealing the outlet end of said discharge spout to prevent the flow of fuel and fuel vapors therethrough when said flow control valve is closed and for opening the outlet end of said discharge spout to permit flow of fuel therethrough when said flow control valve is operated to flow fuel through said flow passage, and actuating means for establishing fluid communication between said flow passage upstream of said flow control valve and said valve means so that said valve means is closed to prevent flow of fuel and fuel vapors out of said discharge spout when said flow control valve is closed and for alternately establishing fluid communication between said flow passage in said discharge spout and said valve means so that said valve means is open to permit the flow of fuel through the outlet end of said discharge spout when said flow control valve is operated to flow fuel through said flow passage.

3. The fuel-dispensing nozzle of claim 2 wherein said valve means includes a pinch valve and wherein said actuating means comprises a first fluid passageway connecting said flow passage upstream of said flow control valve with said pinch valve for flowing fuel from said flow passage upstream of said flow control valve to said pinch valve in order that a fluid pressure is supplied to said pinch valve to close said pinch valve, a check valve located in said first fluid passageway for preventing the flow of fuel from said pinch valve to said flow passage upstream of said flow control valve, bleed valve means operatively connected to said flow control valve and in fluid communication with said pinch valve for opening when said flow control valve is operated to flow fuel through said flow passage and for closing when said flow control valve is closed, said bleed valve means having an inlet port and an outlet port, a second fluid passageway connecting said first fluid passageway downstream of said check valve to the inlet port of said bleed valve means, and a third fluid passageway connecting the outlet port of said bleed valve means to said flow passage in said discharge spout so that when said bleed valve means opens in response to the operation of said flow control valve to flow fuel through said flow passage, fuel will flow out of said pinch valve, the fluid pressure supplied to said pinch valve being greater than the pressure in said flow passage in said discharge spout, through said first fluid passageway, said second fluid passageway and said third fluid passageway into the flow passage in said discharge spout, thereby removing the fluid pressure supplied to said pinch valve in order that said pinch valve opens, fuel flowing through said first fluid passageway to said pinch valve when said bleed valve is closed in order that a fluid pressure is supplied to said pinch valve to close said pinch valve when said flow control valve is closed.

4. The fuel-dispensing nozzle of claim 2 wherein said valve means comprises a wafer valve operable by a pair of inflatable members in fluid communication with each other so that when a fluid pressure is supplied to said inflatable members said wafer valve closes to seal the outlet end of said discharge spout and so that when the fluid pressure is removed from said pair of inflatable members said wafer valve opens to permit the flow of fuel through the outlet end of said discharge spout and wherein said actuating means comprises a first fluid passageway connecting said flow passage upstream of said flow control valve with said pair of inflatable members for flowing fuel from said flow passage upstream of said flow control valve to said pair of inflatable members in order that a fluid pressure is supplied to said pair of inflatable members to close said wafer valve, a check valve located in said first fluid passageway for preventing the flow of fuel from said pair of inflatable members to said flow passage upstream of said flow control valve, bleed valve means operatively connected to said flow control valve and in fluid communication with said pair of inflatable members for opening when said flow control valve is operated to flow fuel through said flow passage and for closing when said flow control valve is closed, said bleed valve means having an inlet port and an outlet port, a second fluid passageway connecting said first fluid passageway downstream of said check valve to the inlet port of said bleed valve means, and a third fluid passageway connecting the outlet port of said bleed valve means to said flow passage in said discharge spout so that when said bleed valve means opens in response to the operation of said flow control valve to flow fuel through said flow passage fuel will flow out of said pair of inflatable members, the fluid pressure supplied to said pair of inflatable members being greater than the pressure in said flow passage in said discharge spout, through said first fluid passageway, said second fluid passageway and said third fluid passageway into the flow passage in said discharge spout, thereby removing the fluid pressure supplied to said pair of inflatable members in order that said wafer valve opens, fuel flowing through said first fluid passageway to said pair of inflatable members when said bleed valve is closed in order that a fluid pressure is supplied to said pair of inflatable members to close said wafer valve when said flow control valve is closed.

5. A method for preventing fuel spillage from a discharge spout of a fuel-dispensing nozzle, the nozzle including a main body portion, the discharge spout projecting from the main body portion and having an outlet end proportioned for ease of insertion into a fill pipe of a fuel tank, a flow passage extending through the nozzle main body portion and the discharge spout for the flow of fuel therethrough, and a flow control valve in the nozzle main body portion operable to regulate the flow of fuel through said flow passage, comprising:

locating a valve means operable by a fluid pressure in the discharge spout adjacent to the outlet end thereof for sealing the outlet end of the discharge spout to prevent the flow of fuel therethrough when said flow control valve is closed and for opening the outlet end of the discharge spout to permit flow of fuel therethrough when said flow control valve is operated to flow fuel through said flow passage; and providing means for supplying a fluid pressure to said valve means to close said valve means to prevent the flow of fuel out of the discharge spout when said flow control valve is closed and for removing the fluid pressure supplied to said valve means to open said valve means to permit the flow of fuel through the outlet end of said discharge spout when said flow control valve is operated to flow fuel through said flow passage.

6. A method for preventing fuel spillage from a discharge spout of a fuel-dispensing nozzle, the nozzle including a main body portion, the discharge spout projecting from the main body portion and having an outlet end proportioned for ease of insertion into a fill pipe of a fuel tank, a flow passage extending through the nozzle main body portion and the discharge spout for the flow of fuel therethrough, and a flow control valve in the nozzle main body portion operable to regulate the flow of fuel through said flow passage, comprising:

supplying a fluid pressure to a valve means located in the discharge spout adjacent to the outlet end thereof in responsive to the closing of said flow control valve so that the outlet end of the discharge spout is sealed to prevent the flow of fuel therethrough when said flow control valve is closed; and removing the fluid pressure supplied to said valve means in response to the operation of said flow control valve to flow fuel through said flow passage so that the outlet end of the discharge spout is open to permit the flow of fuel therethrough when said flow control valve is operated to flow fuel.

* * * * *